US005849164A

United States Patent [19]

Pohto

[11] Patent Number: 5,849,164

[45] Date of Patent: Dec. 15, 1998

[54] CELL WITH BLADE ELECTRODES AND RECIRCULATION CHAMBER

[75] Inventor: Gerald R. Pohto, Mentor, Ohio

[73] Assignee: Eltech Systems Corporation, Chardon, Ohio

[21] Appl. No.: 867,305

[22] Filed: Jun. 2, 1997

Related U.S. Application Data

[60] Provisional application No. 60/020,648 Jun. 27, 1996.

[51] Int. Cl.[6] ..... C25B 11/00

[52] U.S. Cl. ..... 204/288; 204/280; 204/286; 204/289; 204/290 F; 204/290 R; 204/237; 204/254; 204/255; 204/256; 204/268; 204/270

[58] Field of Search ..... 204/280, 286, 204/288, 289, 290 F, 290 R, 237, 254, 255, 256, 268, 270

[56] References Cited

U.S. PATENT DOCUMENTS

| | | | |
|---|---|---|---|
| 3,788,966 | 1/1974 | Stephenson, III et al. | 204/256 |
| 3,970,539 | 7/1976 | Collins et al. | 204/254 |
| 4,149,956 | 4/1979 | Bess, Sr. et al. | 204/284 |
| 4,379,742 | 4/1983 | Rathjen et al. | 204/288 |
| 4,557,818 | 12/1985 | Roos et al. | 204/288 |
| 4,606,805 | 8/1986 | Bon | 204/296 |
| 4,853,101 | 8/1989 | Hruska et al. | 204/296 |
| 4,936,971 | 6/1990 | Pohto | 204/288 |
| 5,135,633 | 8/1992 | Kotowski et al. | 204/280 |
| 5,183,545 | 2/1993 | Branca et al. | 204/252 |
| 5,188,712 | 2/1993 | Dilmore et al. | 204/98 |
| 5,362,366 | 11/1994 | de Nora et al. | 204/280 |
| 5,589,044 | 12/1996 | Scannell et al. | 204/286 |
| 5,660,698 | 8/1997 | Scannell et al. | 204/288 |
| 5,733,424 | 3/1998 | Dehm et al. | 204/288 |

FOREIGN PATENT DOCUMENTS 1072054 2/1980 Canada .

OTHER PUBLICATIONS

1991 London Symposium article entitled Improvement of Electrode Performance Resulting from Combined Optimization of Coating Composition and Structural Design—Carlo Traini, Giovanni Meneghini No month available.

*Primary Examiner*—Bruce F. Bell
*Attorney, Agent, or Firm*—John J. Freer; David J. Skrabec; Michele M. Tyrpak

[57] ABSTRACT

A cell, particularly a membrane cell, that will generally be oriented in an at least substantially vertical positioning, is provided with an array of blade electrodes. The blade electrodes are Delta shape in cross-section, having a flat back face and forwardly sloping sides meeting at a forward edge. Such electrodes can be secured to a current distributor bar, typically on a flat front face of the bar. The forward edge of an electrode blade may be placed opposite a counter electrode of the same or different structure, with a membrane separator usually interposed therebetween. Electrical connection can be made to the electrode blades from the distributor bar, and to the distributor bar through boss electrical connectors. Baffles, which may also be secured to the distributor bar, help establish a front chamber, containing the electrode blades, in front of the baffles, and a back chamber behind the baffles. Electrolyte circulates through the front chamber and recirculates through the back chamber.

60 Claims, 4 Drawing Sheets

CELL WITH BLADE ELECTRODES AND RECIRCULATION CHAMBER

CROSS-REFERENCE TO RELATED APPLICATION

This application claims the benefit of U.S. Provisional Application No. 60/020,648, filed Jun. 27, 1996.

BACKGROUND OF THE INVENTION

1. Technical Field

The present invention relates generally to the art of electrolytic cells and particularly to such cells having a separator and which cells are typically used in preparing chlorine and caustic. The present invention will be described usually with reference to membrane cells which have blade type electrodes.

2. Description of the Prior Art

It is well known to utilize membrane cells for producing chlorine and caustic. The electrolytic cells typically have mesh electrodes that may have bosses directly attached to the mesh electrodes. Such connection is for the purpose of supplying electrical current through the boss connection to the mesh electrode.

For example, in a bipolar filter press electrolyzer, electrical contact can be made through connecting bosses. Such an arrangement, as shown in U.S. Pat. No. 3,788,966, provides a solid electrical and mechanical connection through anode and cathode bosses brought together by a specially prepared, threaded bolt engaging means. The bosses then connect directly with the cell electrodes.

It is also known, particularly for use in mercury cells, to assemble an anode structure having the electrode connected to conductor bars. Thus, in U.S. Pat. No. 4,149,956 there is disclosed an electrode secured to conductor bars. On the region of the conductor bars opposite from the electrode, the bars are secured to primary conductors which receive electrical current through boss connectors. As is also disclosed in this patent, the electrode may be a series of rods although other forms, e.g., blades, are known to be useful.

In the foregoing teachings, the conductor bars interface with the electrode at the edge of the bars, which bars can be arranged vertically on a horizontal electrode. It is also known to orient conductors horizontally, in positioning where a broad face of the conductor faces the electrode. This modified positioning, and referring again to the U.S. Pat. No. 4,149,956 for reference, places the primary conductors in contact with the electrode, and in essence eliminates the vertical conductor bars shown in the patent. In this modified arrangement, electrical current flows from the bosses, secured on the primary conductors, to the primary conductors and from there directly to the electrode. In this arrangement, the electrode may also be in various forms, including mesh, blades, rods and the like.

For efficient operation, particularly of a membrane cell, it would still be desirable to minimize gas blinding of the membrane during cell operation as well as maximize electrode area for reducing cell over-potential. It would also be desirable if the cell geometry could be readily compatible with bipolar or monopolar configurations. It would be particularly desirable if such configurations were constructed in a structure which is easily assembled, and assembled with a highly leak resistant boss connector in a bipolar arrangement, as well as providing an assembly leading to ease of electrode recoating in cell refurbishing.

SUMMARY OF THE INVENTION

The present invention resides in various configurations for cell assembly which provide cells of reduced over-potential as well as minimizing gas blinding of a membrane during cell operation. The configurations as now provided may be readily utilized in the bipolar or monopolar configuration. The configurations provide streamlined gas release, and reduced structural voltage drop. For membrane electrolyzers, rigid membrane support can be obtained. Structures of the invention are easily assembled, providing leak-resistant boss connectors in bipolar cells, and the electrodes may be readily recoated in cell refurbishing.

In one aspect, the invention is directed to an improvement in an electrode structure for use in a vertical electrolysis cell having an at least substantially vertical cathode and an at least substantially vertical electrode structure in the cell opposite the cathode, such electrode structure including blade electrodes spaced apart one from the other, and further including at least one horizontal conductor bar having a front face and a back face, with at least part of the conductor bar engaging a portion of each of the blade electrodes, and with boss electrical connector members secured to the back face of the conductor bar, the improvement in the electrode structure comprising:

- an array of parallel, vertical blade electrodes, Delta shaped in cross-section, each secured on at least a portion of their back face with the conductor bar;
- baffle means having front and back major faces, such baffle means extending vertically and at least substantially parallel to the array of blade electrodes, and having a front major face opposite the back faces of the blade electrodes and spaced apart from the blade electrodes;
- an electrolyte circulation zone extending at least substantially vertically along the front face of the baffle means; and
- an electrolyte recirculation zone extending at least substantially vertically along the back face of the baffle means.

In a related aspect, the invention is also directed to the electrode structure substantially as described above, but comprising the baffle means in association with the electrolyte circulation zone and electrolyte recirculation zone.

In another aspect, the invention is directed to the method of making the above-described electrode structure, which method comprises:

- providing an array of parallel, vertical blade electrodes, Delta shaped in cross-section, each secured on at least a portion of their back face with the conductor bar;
- affixing baffle means having front and back major faces, to the conductor bar and extending such baffle means vertically at least substantially parallel to the array of blade electrodes, with the baffle means front major face positioned opposite the back faces of the blade electrodes and spaced apart from these blade electrodes;
- establishing an electrolyte circulation zone extending vertically along the front face of the baffle means; and
- establishing an electrolyte recirculation zone extending vertically along the back face of the baffle means.

In yet a further aspect, the invention is directed to the method of refurbishing the above-described electrode structure, which method includes:

- retaining the electrode structure of coated blade electrodes engaged to the conductor bar with boss electrical connector members secured thereto;
- removing old coating from the blade electrodes without removing the electrodes from the electrode structure;
- recoating these blade electrodes and including elevated temperature heating in the recoating; and thereby exposing the electrode structure to such elevated temperature of the elevated temperature heating.

In another aspect, the invention is directed to the method of electrolyzing an electrolyte in an electrolytic cell having the above-described electrode structure, which method comprises:

providing an array of parallel, vertical blade electrodes, generally Delta shaped in cross-section, each secured on at least a portion of their back face with the conductor bar;

providing electrical connection to the blade electrodes from the boss electrical connector members through the conductor bar;

establishing baffle means having front and back major faces, these baffle means extending vertically and at least substantially parallel to the array of blade electrodes, with the front major face of the baffle means positioned opposite the back faces of the blade electrodes, and spaced apart from the blade electrodes, providing an electrolyte circulation zone in front of the baffle means, and including the blade electrodes in the electrolyte circulation zone;

feeding electrolyte into the electrolyte circulation zone and circulating same vertically along the front face of the baffle means and in contact with the blade electrodes;

feeding electrolyte from the electrolyte circulation zone to an electrolyte recirculation zone extending vertically along the back face of the baffle means; and recirculating electrolyte along the back face of the baffle means through the recirculation zone.

In yet a further aspect, the invention includes a bipolar electrolytic cell having an anode and a cathode, with each electrode of the cell having a boss electrical connector member associated therewith, and with the structure having cell divider means interposed between adjacent anodes and cathodes, the improvement in such electrode structure comprising:

an anode boss electrical connector member abutting against an adjacent cathode boss electrical connector member, such anode and cathode boss electrical connector members each having a hole extending transversely therein, at least one hole being at least partially internally threaded, and with adjacent transverse holes being coaxially aligned in the electrode structure;

a securing member contained within coaxially aligned adjacent holes, the securing member having an externally threaded shank;

a circumferential sealing member around the end of the shank adjacent the head;

a recess around adjacent boss electrical connector members for receiving the cell divider means; and baffle means affixed to a conductor bar that is itself secured to at least one boss electrical connector member, such baffle means extending away from said boss, electrical connector member and establishing an electrolyte recirculation zone extending around the boss electrical connector member between the baffle means and the cell divider means.

The invention is also directed to a blade electrode adapted for use in an electrolysis cell having an array of parallel blade electrodes spaced apart one from the other, which blade electrode comprises an elongate electrode, chevron Delta shape in cross-section, having a front, rounded edge, a two-sided working front face and an inner back face, with these front and back faces extending into rounded back edges.

DESCRIPTION OF THE PREFERRED EMBODIMENTS

Figures 1, 1A, 1B:
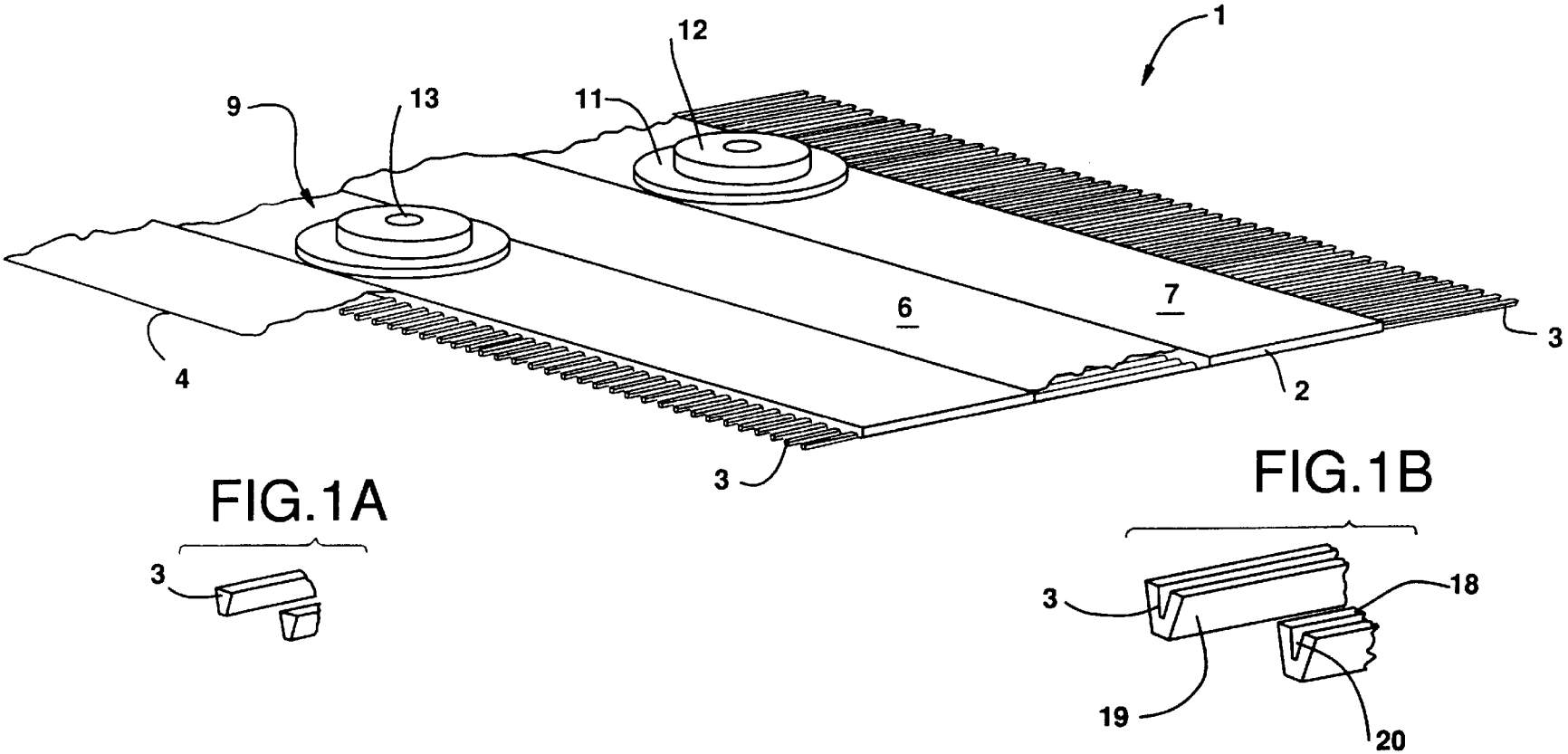
FIG. 1 is a perspective view of an electrode structure of parallel blades supported on distributor bars, with the distributor bars having threaded boss electrical connecting members, and the electrode structure having a separated back chamber providing for electrolyte recirculation.
FIG. 1A is an enlarged perspective view highlighting a triangular Delta shape for the blade electrodes that can be used in the electrode structure of FIG. 1.
FIG. 1B is an enlarged perspective view, more greatly enlarged than FIG. 1A, highlighting a chevron Delta shape for the blade electrodes that can be used in the electrode structure of FIG. 1.

The electrolytic cells employing the present invention can typically be useful for the electrolysis of a dissolved species contained in a bath, such as in electrolyzers employed in a chlor-alkali cell to produce chlorine and caustic soda, or in an electrolysis process producing chlorate. The electrolyzers can be useful to produce products such as potassium hydroxide or sodium sulfate, e.g., can be utilized for the electrolysis of salt solution such as sodium chlorate and sodium sulfate, to regenerate acid and base values. Other uses include electrolytic destruction of organic pollutants, water electrolysis, electro-regeneration of intermediates, and electrolysis of sodium carbonate. For the present invention, the cells will be most useful when operating in an at least substantially vertical mode. Thus, they will contain a cathode and an anode that are at least substantially vertically positioned. By being "at least substantially vertical", it will be understood that the cell and cell elements need not be positioned completely upright, but may be canted from the vertical although maintaining a more vertical than horizontal positioning. For convenience, when the term "vertical" is used herein, it is to be understood to mean "at least substantially vertical" positioning unless otherwise specified.

The metals of the electrode, when serving as an anode, will most always be valve metals, including titanium, tantalum, zirconium and niobium. Of particular interest for its ruggedness, corrosion resistance and availability is titanium. As well as the normally available elemental metals themselves, by use of the word "metals" herein, it is to be understood that the suitable metals can include their metal alloys and intermetallic mixtures. For example, titanium may be alloyed with nickel, cobalt, iron, manganese or copper. By use of elemental metals, it is most particularly meant the metals in their normally available condition, i.e., having minor amounts of impurities. Thus, for the metal of particular interest, i.e., titanium, various grades of the metal are available including those in which other constituents may be alloys. Preferably, for best ease of making the anode, the metal is grade 1 titanium. It will be understood that for the anode the metal will virtually always be coated, which coatings will be more fully discussed hereinbelow. For convenience, there may be used herein terms such as "the metal anode" or "the coated metal anode".

The metals of the electrode, when serving as a cathode in the electrolytic cell, can include nickel, or steel such as carbon steel and stainless steel, or nickel plated steel, as well as valve metals such as titanium. Other metal cathodes can be in intermetallic mixture or alloy form, such as iron-nickel alloy, or alloys with cobalt, chromium or molybdenum, or the metal of the cathode may essentially comprise nickel, cobalt, molybdenum, vanadium or manganese. The active electrode surface area of the cathode can be uncoated, e.g., a bare, smooth nickel metal cathode. Alternatively, the active surface for the cathode might be a layer of, for example, high surface area nickel or Raney nickel, or a layer of molybdenum, or an oxide thereof which might be present together with cadmium. Other metal-based cathode layers can be provided by alloys such as nickel-molybdenum-vanadium, nickel-molybdenum and nickel-phosphorous. Such activated cathodes are well known and fully described in the art.

Referring then to FIGS. 1, 1A and 1B, there is shown an electrode structure 1 that is representative of the present invention and comprises current distributor bars 2 also termed herein "conductor bars" 2. Although the electrode structure 1 may serve in a cell and comprise an anode, or it may serve in a cell and comprise a cathode, or such structure might be used for both in the same cell, for purposes of convenience, such structure will generally be simply referred to herein for convenience as the "anode structure 1", particularly when referring to the drawings. Consequently, the counter electrode is referred to as the cathode. Where the structure 1 comprises an anode assembly, the conductor bar 2 may be a metal bar 2 such as of valve metal, typically titanium. Where the structure 1 comprises a cathode assembly, the conductor bar 2 may be a metal bar such as of nickel or carbon steel. The structure of FIG. 1 is shown in horizontal positioning, but it is to be understood, as discussed hereinabove, that the structure is contemplated for use in vertical positioning.

In FIG. 1, positioned under the current distributor bars 2 are an array of parallel blade electrodes 3, e.g., a multitude of parallel anode blades 3. These blades 3 are generally Delta shaped in cross-section. By being generally "Delta shaped" in cross-section, or at least substantially "Delta shaped" in cross-section, as the terms are used herein, the blades 3 are either triangular Delta shaped in cross-section (FIG. 1A) or chevron Delta shaped in cross-section (FIG. 1B). When Delta shaped, the blades 3 have a two-sided working, or active, front face 19, e.g., an electrochemically active front face 19, and a back face 18. When chevron Delta shape in cross-section, the anode blades 3 also have a two-sided working, or active, front face 19, but have as well a two-sided inner face 20, which may or may not be a working, or active, inner face 20. Where there is blade thickness at the blade top, as depicted in FIG. 1B, between the front and back faces 19, 20, this thickness can provide two long and narrow back faces 18*a* for the chevron Delta blade 3, sometimes also referred to herein as the back edges 18*a*. These back faces 18*a* may be flat or rounded. The anode blades 3 extend the full height of the structure 1 when such structure 1 is in its usual vertical position, and extend across typically several current distributor bars 2. When the blades 3 are vertical, the bars 2 are positioned cross-wise along the blades in the manner of a strip, as depicted in FIG. 1. These strips extend horizontally along the blades 2. Because of this, they may sometimes be referred to herein as the "horizontal" conductor bars 2.

Figure 2:
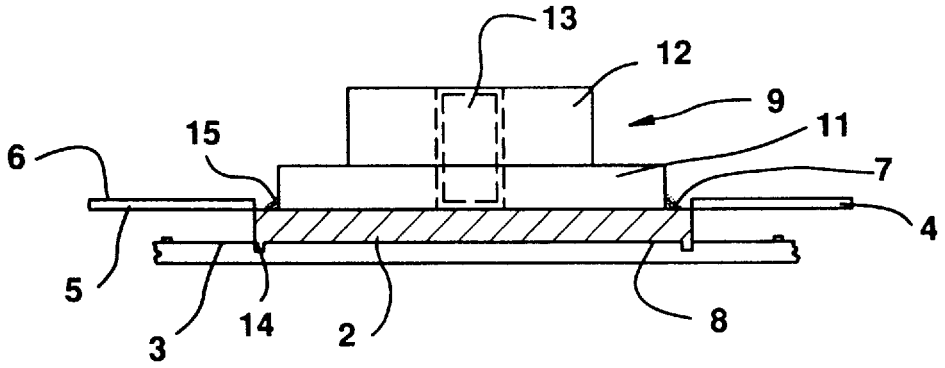
FIG. 2 is an elevational cross-section of a portion of the electrode structure of FIG. 1 which includes a distributor bar and threaded boss electrical connector member.

In the space between adjacent current distributor bars 2 and spaced above the anode blades 3 are baffle means 4, usually referred to herein simply as "baffles 4". The baffles 4 extend upwardly, or at least substantially vertically, in the space between adjacent bars 2. Each baffle 4 has a front face 5 (FIG. 2) that faces the anode blades 3. Each baffle 4 also has a back face 6 which may also be referred to herein as an electrolyte recirculation side 6. In similar fashion, each current distributor bar 2 has a back face 7 as well as a front face 8 (FIG. 2) which may also be referred to herein as the "controlling" face 8. As seen in the figure, the baffle 4 has the two major faces 5, 6 and an edge and is generally in sheet form. That is, the baffle 4 is typically very thin while having a large surface area, although shapes for the baffle 4 other than sheet form are contemplated. Likewise, the current distributor bar 2 has front and back major faces 7, 8 and an edge and is generally plate shaped. It can be thicker than the baffles 4, and may have a substantial surface area. It will be understood that shapes other than plate shape are contemplated. Spaced along the back face 7 of the current distributor bar 2 are boss electrical connector members 9, usually referred to as "flanged bosses" 9, or simply "bosses" 9. Each boss 9 has a bottom flange 11 and a boss top 12. The boss 9 also has a hole, or "aperture", 13, that is usually referred to herein as a tapped hole 13 which, as shown in the figure, may extend through the boss 9 for receiving a securing member 46 (FIG. 5) for providing firm electrical connection for the boss 9 to the face of the mating boss 43. Electrical current flows through the bosses 9 to the bars 2 and then to the anode blades 3. Extending slightly from each side of each current distributor bar 2 are keys 14 (FIG. 2). Each anode blade 3 is indented slightly within each key 14.

Figure 5:
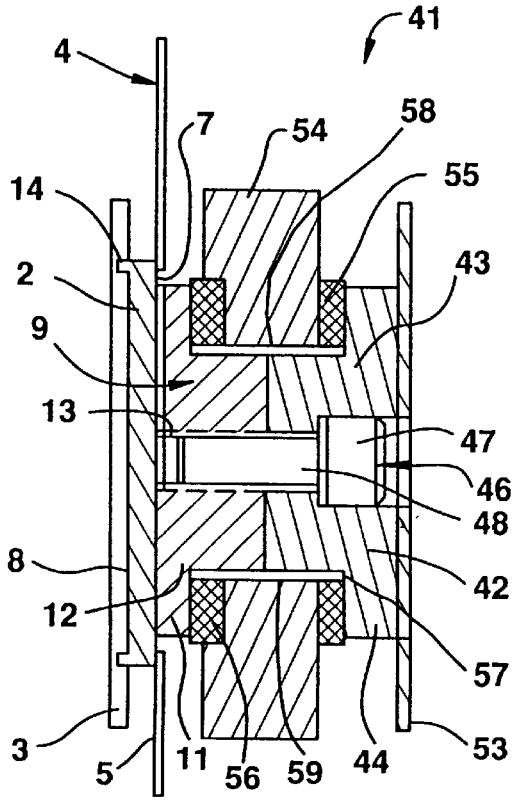
FIG. 5 is an elevational cross-section of a bipolar cell connector assembly having, in part, the distributor bars and separated back chamber of FIG. 1, with the boss electrical connector members, plus fastening means.
Figure 6:
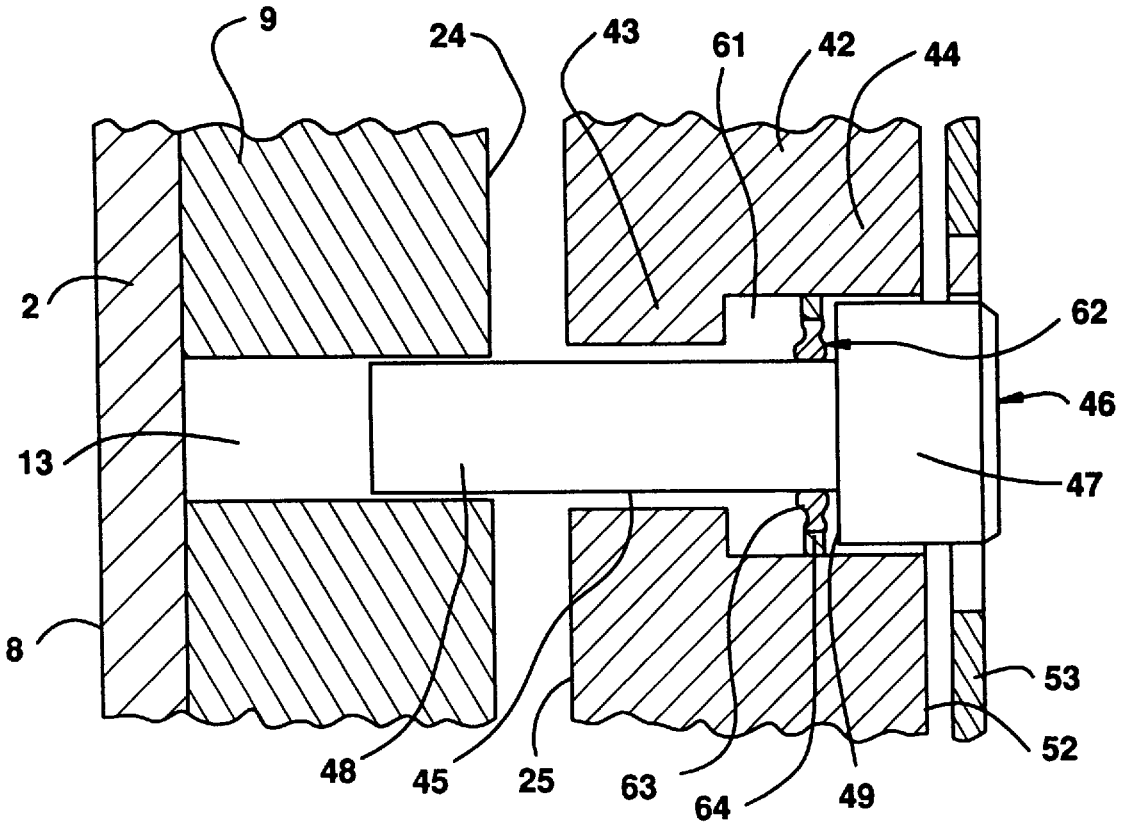
FIG. 6 is an elevational, partially exploded cross-sectional view of a portion of the bipolar cell connector assembly of FIG. 5 depicting the fastening means of FIG. 5, together with sealing means.

Referring then to FIG. 2, the anode blades 3 are seen to be indented within each key 14 of a current distributor bar 2. By being indented within the keys 14, the anode blades 3 can be in contact against the controlling face 8 of the current distributor bar 2. By being indented within and thereby engaging the keys 14, the blades 3 are secured on at least a portion of the current distributor bars 2. However, the blades 3 could be engaged, as by welding, with the entire face 8 of the current distributor bar 2, although such is usually avoided, for economy. Seated on the back face 7 of the current distributor bar 2 is a flanged boss 9 having a bottom flange 11, boss top 12 and tapped hole 13, which may be internally threaded. It is desired that at least one aperture 13 be internally threaded so as to provide bolted fastener 46 (FIG. 5) between electrode contact faces 24, 25 (FIG. 6). Such a bolted fastener 46 can provide contact pressure between these faces 24, 25. A metal flanged boss 9 can be secured to a metal current distributor bar 2 by welding 15, e.g., by one or more of electrical resistance welding, TIG (tungsten-inert gas) welding or MIG (metal-inert gas) welding. Extending from the back face 7 of the current distributor bar 2 are baffles 4 spaced apart from the anode blades 3. Each baffle 4 has a front face 5 facing the anode blades 3 and a baffle back face 6, and the baffle 4 is situated at least substantially parallel to the anode blades 3.

Figure 3:
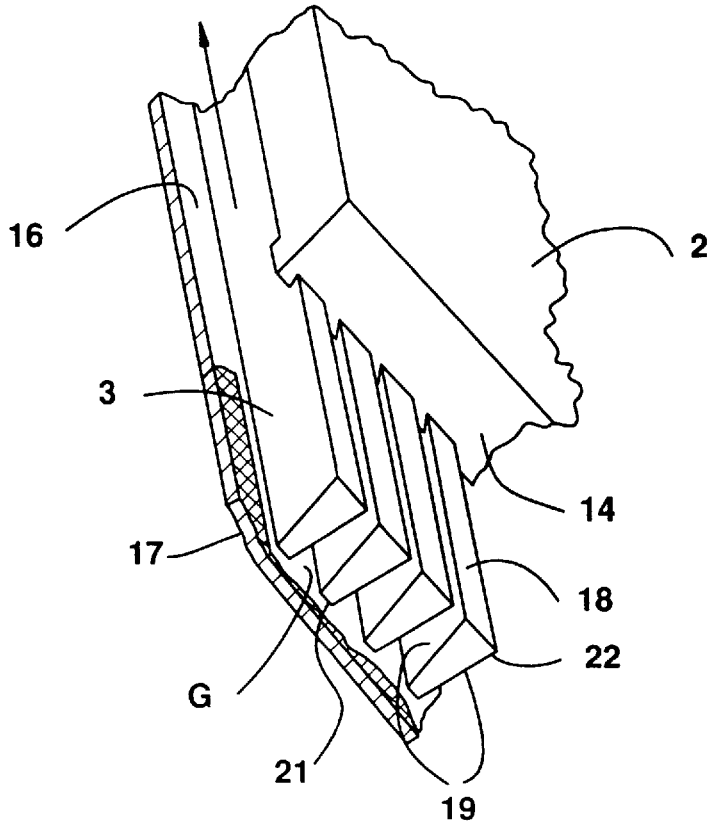
FIG. 3 is a partial perspective view of an array of parallel blades of Delta shaped cross-section as one electrode engaging a distributor bar and separated by a small gap from a separator which is present on a counter electrode.

Referring then to FIG. 3, an array of anode blades 3, of Delta shape in cross-section, are indented slightly into a key 14 of a current distributor bar 2. Each anode blade 3 of triangular Delta shape has a back face 18. Whether of triangular Delta shape or chevron Delta shape, the blade 3 has a two-sided working front face 19, which may sometimes be referred to herein for convenience simply as the "working" face 19. The two-sided working face 19 narrows down away from the back face 18 to a front, or forward, edge 21. For either the triangular Delta shape or the chevron Delta shape, the front edge 21 is preferably a rounded edge 21 rather than a sharp edge 21 for more even current distribution. Also, at the back, e.g., at the edges of the back face 18, the anode blades 3 preferably have rounded back edges 22, rather than sharp corners for enhanced ease of attachment of the blades 3 by welding and to provide less turbulent flow of electrolyte past the blades 3. For the triangular Delta shape, the anode blades 3 have a full back face 18, but for the chevron Delta shape, these blades 3 have back faces 18*a* (FIG. 1B) composed of the upper surfaces between the rounded back edges 22 of the blades.

In FIG. 3, the orientation of the structure, but depicted without the baffle means 4 (FIG. 2), is shown more closely aligned to its usual vertical positioning. In such positioning, electrolyte flow through an electrolyte circulation zone 10 past the anode blades 3, e.g., between adjacent anode blades 3, is usually upwardly in the manner as shown in the figure by the arrow. The anode blades 3 are thus positioned within the electrolyte circulation zone 10. Where the structure of FIG. 3 would be utilized as an anode in an electrolytic cell, such as where chlorine or oxygen might be produced at the anode blades 3, the chlorine or oxygen bubbles generated along the anode blades 3 would likewise rise in the direction of the arrow. These would rise along the anode front face 19 for a triangular Delta shape blade 3, and it is contemplated that they could rise along both the anode front face 19 and back face 20 for a chevron Delta shape blade 3. Thus, both the front face 19 and the back face 20 may be coated with an electrochemically active coating. Alternatively, it is also contemplated that the back face 20 of a chevron Delta blade anode could be blocked from contact with electrolyte, such as by plugging the ends of the anode blade 3. In this arrangement, it would be uneconomical to coat the back face 20.

In operation, upward electrolyte flow in the electrolyte circulation zone 10 that includes flow past the anode blade 3 will also include flow along the front face 5 of the baffles 4 (FIG. 2) and the space between the blade front edge 21 and a membrane 16. The electrolyte circulation zone 10 extending vertically along the cell can then have a depth varying, on the one hand, the distance between the membrane 16 and the baffle front face 5 and, on the other hand, the distance between the membrane 16 and the current distributor bar front face 8. Most always, the baffles 4 will be solid, imperforate baffles that do not permit electrolyte flow through the baffles 4. Electrolyte flow, together with any gas generated during cell operation, will proceed upwardly in the electrolyte circulation zone 10, usually until the top end (not shown) of the anode blades 3. At the top end, the gas disengages from the electrolyte for processing (not shown) and the electrolyte will typically be permitted to spill over the top end of the baffle 4 and flow downwardly into an electrolyte recirculation zone 20 (FIG. 4) extending down the back face 6 of the baffle 4 (FIG. 2). The depth of this electrolyte recirculation zone 20 is typically bounded between the back face 6 of the baffle 4 and the opposing face of a cell divider 54 (FIG. 5). At the bottom end (not shown) of the baffle 4, the electrolyte can be permitted to flow around the bottom end and circulate back upwardly along the baffle front face 5. In this manner, electrolyte can be continuously circulated in the cell. In FIG. 3, the anode blade front edges 21 are spaced slightly away by a gap G from a membrane 16 which is positioned on a cathode 17.

In assembly, metal current distributor bars 2 can have their front face 8 machined down to provide keys 14. Then, baffles 4 can be affixed to the back faces 7 of the current distributor bars 2. Then the bosses 9 can be prepared, as by providing a tapped hole 13 through both a bottom flange 11 and a boss top 12 and then bringing these elements 11, 12 together to form the boss 9. In making the tapped hole 13, at least a part of the inner surface, e.g., the surface within the flange 11, can be internally threaded. Since the bars 2 and baffles 4 are positioned at least substantially vertical, as discussed hereinabove, the holes 13 are at least substantially horizontal, and may therefore sometimes be referred to herein as "transverse" holes 13. Next, the bosses are secured to the back faces 7 of the current distributor bars 2. Lastly, the anode blades 3 are affixed in the keys 14 of the bars 2. Except where the baffles 4 can be of a polymeric material, as discussed hereinbelow, the entire structure 1 may be metallic, e.g., all of titanium for an anode structure 1. In refurbishing a cell, such structure 1 may be removed intact, i.e., without further disassembly other than for separation of polymeric baffles 4 from the balance of the structure 1. In such refurbishing, the blades can be conditioned as is usual in the field of anode refurbishing for electrochemical cells, e.g., removal of old coating and subsequent recoating. In such operation where baking of freshly applied coating composition will be entailed, the entire metal structure 1 may be subjected to such operation, such as placement in an oven, without deleterious affect to the structure 1. After refurbishing, which can then include freshly coated blades 3, the structure 1 may then have baffles 4 affixed thereto and the completed structure 1 reinserted in a cell. Typically after positioning this anode structure 1 in a cell, electrical connection is made so that, for a bi-polar cell, current passes across the faces 24, 25 (FIG. 6) of the bosses 9, 42 (FIG. 5).

Figure 4:
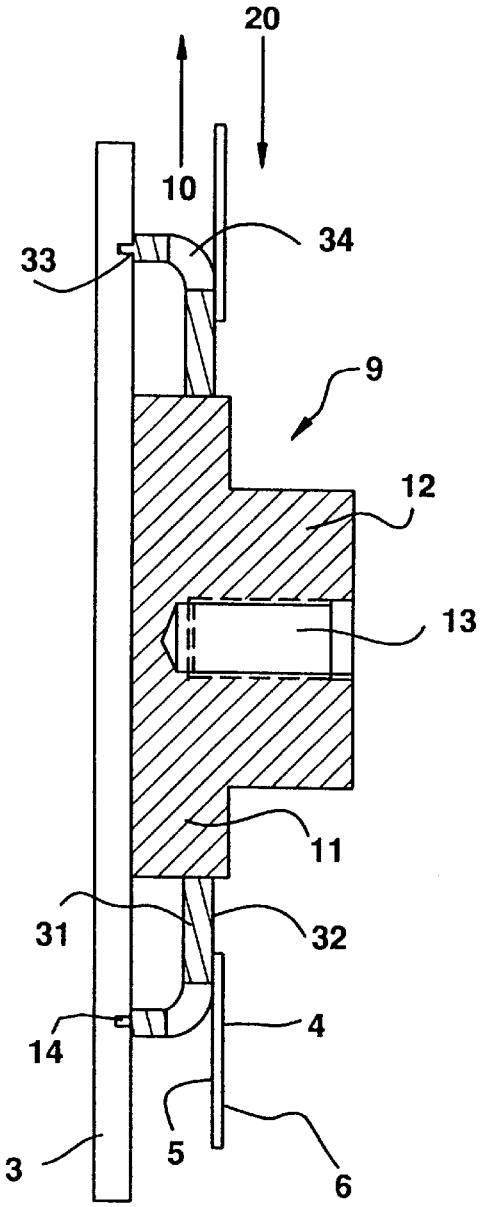
FIG. 4 is an elevational cross-section of a portion of an electrode structure depicting a variation of a distributor bar with a boss electrical connector member.

Referring next to FIG. 4, anode blades 3 are indented within keys 14. However, for the variation shown in this figure, the keys 14 are at the end of legs 31 which extend from the bottom flange 11 of a flanged boss 9. These legs 31 can be metal legs 31 of a material such as for the current distributor bar 2, e.g., valve metal legs 31 for an anode assembly. For a cathode assembly, they may be, for example, nickel or steel legs 31. The flanged boss 9 also has a boss top 12 and a tapped hole 13 which, as seen in this figure, need only extend partially into the boss 9. The legs 31 extending outwardly from the bottom flange 11 provide initially a flat upper leg surface 32. Positioned on this flat upper surface 32 and extended outwardly therefrom are baffles 4. As was the case for the structure depicted in FIG. 2, these baffles 4 of FIG. 4 have a baffle front surface 5 facing the anode blades 3 as well as a baffle back face 6, which is also an electrolyte recirculation face 6. In this construction of the FIG. 4, the blades 3 are indented into the key 14 until they are flush against the leg key way surface 33. In this position, the blades 3 remain spaced apart from the boss 9. Between the key 14 and the flat upper surface 32, the legs 31 permit an electrolyte flow in the electrolyte circulation zone 10 through aperture 34. The electrolyte recirculation zone 20 is then defined in part by the baffle back face 6.

In FIG. 4, assembly can be initiated by affixing, as by welding, metal legs 31 to the bottom flange portion 11 of a flanged metal boss 9. The metal legs 31 can already have the flow apertures 34 and the keys 14 present in the legs 31, such as prepared by drilling and machining the legs 31. Also, the metal boss 9 can have the tapped hole already present in the boss 9. Next, the baffles 4 can be secured to the upper surfaces 32 of the legs 31. Lastly, the anode blades 3 are joined at the keys 14 to the boss 9.

Referring then to FIG. 5, a bipolar cell connector assembly 41 has anode blades 3 indented within each key 14 of a current distributor bar 2. The blades 3 thus engage against the controlling face 8 of the current distributor bar 2. On the back face 7 of the current distributor bar 2 is a flanged boss member 9, or "first" boss member 9. This boss member 9 has a bottom flange 11, boss top 12 and transverse tapped hole 13. The transverse hole 13 extends completely through the boss member 9. The transverse tapped hole 13 can be internally threaded (not shown). The flanged boss member 9 can be secured to the current distributor bar 2 by welding 15 (FIG. 2). Extending from the back face 7 of the current distributor bar 2 are baffles 4. These baffles 4 establish the electrolyte circulation zone 10 along their front face 5. The boss top 12 has an outer face 24 (FIG. 6) that is in face to face engagement with an outer face 25 (FIG. 6) of a facing electrode boss member 42, or "second" boss member 42. This facing electrode boss member 42 has a boss top 43 as well as a bottom flange 44. A transverse hole 45 (FIG. 6), which can be a drilled hole 45, and that extends completely through this facing electrode boss 42 is positioned coaxially with the transverse tapped hole 13 of the flanged boss 9. Inserted within this transverse coaxial hole 13 or 45, is a securing member or fastener 46, having a head 47 and a shank 48, which shank 48 can be externally threaded (not shown). The head 47 is contained within an enlarged recess 61 (FIG. 6) within the boss member 42 and this head 47 necks down to provide the shank 48 and thereby provides an inner head surface 49 (FIG. 6). Around this inner head surface 49 is a circumferential sealing member 62 (FIG. 6).

The second electrode boss 42 has a front face 52 (FIG. 6). On this front face 52 is an electrode 53, typically a mesh cathode 53. The bottom flanges 11, 44 of the flanged bosses 9, 42 provide boss recesses 58, 59 for the bipolar cell connector member 41. Inserted within these recesses 58, 59 is a cell divider 54 or "central barrier member" 54, which can be made of a polymeric material such as polypropylene, polyvinylidene chloride, or chlorinated polyvinyl chloride, or of a metal, e.g., a metal used for the bosses 9, 42 such as titanium or carbon steel. Compressed between this cell divider 54 and the bottom flanges 11, 44 are sealing members 55, 56, usually gaskets 55, 56 but which may be provided by a putty or a mastic which can be formed in place. These gaskets 55, 56 and cell divider 54 protrude into the recesses 58, 59, and may flow into the gap 57 creating a hydraulic like pressure seal.

Referring then to FIG. 6, a portion of the bipolar cell connector assembly 41 as shown in FIG. 5 has a current distributor bar 2. This bar 2 has a front face 8 and a back face 7 (FIG. 5). This back face 7 is in contact with a first boss member 9. The first boss member 9 has a transverse hole 13 that extends completely through the boss member 9. Extending within the hole 13 is the shank 48 of a fastener 46. The shank 48 of the fastener 46 also extends through the transverse, facing hole 45 of a second, or facing, electrode boss 42. This facing electrode boss 42 has a front face 52 which is in contact with an electrode 53. This boss 42 has a boss top 43. In this second boss 42, the transverse hole 45, e.g., a drilled hole 45, enlarges to an enlarged recess 61 which can be counter bored into the boss member 42. This enlarged recess 61 accommodates the head 47 of the fastener 46. Within the enlarged recess 61 is a seal ring means 62 around the shank 48 of the fastener 46. This seal ring means 62 is comprised of a circumferential gasket member 63 that is integral with a circumferential gasket frame 64. For example, the gasket member 63 can be molded to the gasket frame 64. On completing assembly of this structure, the seal ring means 62 is positioned against the inner head surface 49 of the fastener 46.

The first flanged boss 9 has an outer face 24 which is in face to face engagement with an outer face 25 of the facing electrode boss 42. By utilizing the seal ring means 62, the electrical contact across these boss faces 24, 25 may be maintained constant. Also, when the head 47 of the fastener 46 moves against the seal ring means 62, the gasket member 63 provides a desirable seal while the gasket frame 64 will be non-yielding between the boss top 43 and the bolt head 47. Further, by utilizing this seal ring means 62 under the head 47 of the fastener 46, a sealing protection is provided for the electrical junction between the boss outer faces 24, 25. Where the first flanged boss 9 is a metal boss 9 utilized with an anode, the metal of the flanged boss 9 may typically be a valve metal, particularly titanium. The metal boss outer face 24 may be a coated face. Such a coated outer face 24 may be a metal plated face, e.g., plated with a metal such as platinum or other electrically conductive plating metal such as nickel. Similarly, where the facing electrode boss 42 is a metal boss 42 and it is utilized with a cathode, the boss 42 may typically be of a metal such as nickel or steel. The metal boss 42 outer face 25 of such cathode boss 42 may be coated. For example, if the boss 42 is a steel boss 42, the coating could be a metal coating, such as a plated metal coating. These coatings for the steel cathode boss 42 can be represented by silver or nickel electroplated metal. For coating these outer faces 24, 25, in addition to electroplating, metal coatings might be applied such as by plasma spray or ion plating.

In assembling the cell connector assembly 41, the anode structure 1 of FIG. 1 can be first assembled in a manner as hereinbefore described. Then, all of the facing electrode boss members 42 can have the facing hole 45 prepared therein. These boss members 42 can then be aligned, and placed against, the facing flanged bosses 9. Next, a fastener 46 can be affixed with a circumferential sealing ring means 62, and the fastener 46 inserted and secured in the transverse, coaxially tapped holes 13, 45. Sealing members 55, 56 can be inserted into the recesses 58, 59 and the central barrier member 54 also is pressed into these recesses 58, 59 and against the sealing members 55, 56. Lastly, an electrode 53 can be joined to the facing electrode boss member 42.

Although it is contemplated that indentations may be preformed into the key 14 of the current distributor bar 2, such need not be the case. For example, the key 14 may provide a uniform flat surface prior to engagement with the anode blades 3. Then the anode blades 3 could be indented into the flat surface of the key 14 during fastening of the anode blades 3 to the key 14. By way of example, the anode blades 3 can be placed so that their back faces 18 are flush against a uniform flat face of the key 14. Then welding can be selected as the means for securing the anode blades 3 to the key 14. In this operation, the welding can provide for melting of not only the portion of the blade back face 18 in contact with the face of the key 14 but also of such face of the key 14. When these facing zones melt, the melting metal from the key 14 and blade 3 pools, and the anode blade 3 under pressure exerted on the blade 3 against the current distributor bar 2 can be sufficient for providing the indentation of the anode blade 3 into the key 14. Thereafter, the melt phases of the contact faces can be permitted to solidify, resulting in the indentation of the anode blade 3 into the key 14 of the conductor bar 2 in a final metal nugget position from the welding.

The indentation of the anode blade 3 into the key 14 provides that the anode blade 3 is secured to the current distributor bar 2 in a "jointed manner". As this term is used herein, it is meant to refer to the elements being secured together in more than just surface contact. The indentation 3 of the blade 3 helps to securely affix, or join, the blade 3 and current distributor bar 2 together. Other arrangements for securing the blade 3 in a jointed manner can include a dovetailed joint between the blade 3 and the bar 2, such as where the key 14 is precut to permit the fitting of the bar 3 within the precut portion and form the dovetailed joint.

By spacing the anode blades 3 apart from one another, there is assured sufficient metal on pooling of the metal from the keys 14 and the blade so as not to weld together adjacent blades 3 with the final weld nugget. Moreover, spacing blades 3 apart can assist in ease of attachment without crowding and the resulting structure will provide desirable electrolyte flow. For blades that might have a thickness of from about 0.05 to 0.1 inch across the back face 18 of the blade 3, i.e., as measured transversely to the elongation of the blade 3 across the back face 18 (or the faces 18*a*), a spacing of from about 0.3 to about 0.5 inch between blade front edges 21 can provide for serviceable blade spacing. Blades 3 of such thickness typically have a blade height, from the back face 18 to the front edge 21, on the order of from about 0.2 inch to about 0.3 inch.

The baffles 4 are typically metal or polymeric baffles 4. As metal baffles 4, they usually comprise a valve metal, most often titanium. As a metal baffle 4, they may be secured to the current distributor bar 2 by any means typically used for securing metal members together. This will usually be by welding, such as electrical resistance welding. Where the baffles 4 are polymeric baffles 4, for desirable resistance to electrolyte, they are usually fluorinated polymer baffles 4. Representative polymers for these baffles 4 can include polytetrafluoroethylene and fluorinated ethylene propylene resin. As polymeric baffles 4, they can usually be fastened to the current distributor bar 2 by readily releasable means providing ease of removal of the baffles 4 from the bar 2, e.g., as by bolting; or, more generally, by any other means for securing polymeric material to metal. Polymeric baffles 4 are almost always removed from the electrode when the anode blades 3 are recoated, as has been discussed hereinabove. Although the baffles 4 are shown as extending to an edge of the back face 7 of the current distributor bar 2, it will be understood that other assembly is contemplated, e.g., the baffle 4 could be a single sheet and extend over the entire back face 7 of the current distributor bar 2.

The fastener 46 is always contemplated to be a metal fastener 46, e.g., a metal hex socket cap screw, since it is utilized for electrical connection to the bosses 9, 42. The metal of the fastener 46 is advantageously the same as the metal for the cathode. Typical metals for the fastener 46 thus include nickel, stainless steel, carbon steel or nickel plated steel. The interior surface of the aperture 13 of the boss 9 may be treated, such as with a solid lubricant. This can be particularly useful when applied to any threaded portions of the fastener 46 and a tapped hole 13 so as to prevent seizing or galling between the threaded parts, such as between a titanium boss 9 and a nickel fastener 46.

The seal ring means 62 may comprise, as shown in FIG. 6, a gasket member 63 and a gasket frame 64. The gasket member 63, as well as the sealing members 55, 56 when present as gaskets, can be of any resilient material typically useful for such service. These gasket materials can include natural rubber, neoprene or the terpolymer from ethylene-propylene diene monomer. The frame 64 may be a metal frame, e.g., of a metal such as carbon steel, stainless steel or nickel.

The cathode of the electrolytic cell, when not the structure of the invention, may be other structures, e.g., rods or other design including foraminous structure. A typical foraminous metal cathode is an expanded metal, e.g., an electrode mesh with each diamond of mesh having an aperture of about 1/16 inch to 1/4 inch or more dimension for the short way of the design, while generally being about 1/8 to about 1/2 inch across for the long way of the design. The cathode may, however, be a perforated plate, or wire screening, or a punched and pierced louvered sheet or the like. Also, when the electrode is an anode in an electrolytic cell and is not in the structure of the invention, the anode may take various forms, e.g., the form of an expanded metal mesh, rods, woven wire, or punched and pierced louvered sheet.

It is contemplated that the electrolytic cell will be provided with any of those separators as are known to be used in cells, and which include membranes and diaphragms as well as ceramic separators and the like. Membranes suitable for use as a separator member can readily be of types which are commercially available. One presently preferred material is a perfluorinated copolymer having pendant cation exchange functional groups. These perfluorocarbons are a copolymer of at least two monomers with one monomer being selected from a group including vinyl fluoride, hexafluoropropylene, vinylidine fluoride, trifluoroethylene, chlorotrifluoroethylene, perfluoro (alkyvinyl ether), tetrafluoroethylene, and mixtures thereof.

The second monomer often is selected from a group of monomers usually containing an $SO_2F$ or sulfonyl fluoride pendent group. Examples of such second monomers can be generically represented by the formula $CF_2{=}CFR_1SO_1F$. $R_1$ in the generic formula is a bifunctional perfluorinated radical comprising generally one to eight carbon atoms, but upon occasion as many as twenty-five. One restraint upon the generic formula is general requirement for the presence of at least one fluorine atom on the carbon atom adjacent the $SO_2F$ group, particularly where the functional group exists as the —(—$SO_2NH$)mQ form. In this form, Q can be hydrogen or an alkali or alkaline earth metal cation and m is the valence of Q. The $R_1$ generic formula portion can be of any suitable or conventional configuration, but it has been found preferably that the vinyl radical comonomer join the $R_1$ group through an ether linkage.

Such perfluorocarbons generally are available commercially, such as through E. I. dupont, their products being known generally under the trademark NAFION. Perfluorocarbon copolymers containing perfluoro (3, 6-dioxa-4-methyl-7-octenesulfonyl fluoride) comonomer have found particular acceptance.

It is also contemplated that the separator member can be a diaphragm, which may sometimes be referred to herein as a "diaphragm porous separator". For the diaphragm, a natural material such as asbestos fiber may be used in forming the diaphragm, or a synthetic material such as a synthetic fiber used in a synthetic, electrolyte permeable diaphragm can be utilized, or the diaphragm may be a combination of natural and synthetic material. The synthetic diaphragms generally rely on a synthetic polymeric material, such as polyfluoroethylene fiber as disclosed in U.S. Pat. No. 5,606,805 or expanded polytetrafluoroethylene as disclosed in U.S. Pat. No. 5,183,545. Such synthetic diaphragms can contain a water insoluble inorganic particular, e.g., silicon carbide, or zirconia, as disclosed in U.S. Pat. No. 5,188,712, or talc as taught in U.S. Pat. No. 4,606,805. Of particular interest for the diaphragm is the generally non-asbestos, synthetic fiber diaphragm containing inorganic particulates as disclosed in U.S. Pat. No. 4,853,101. The teachings of this patent are incorporated herein by reference.

As representative of the electrochemically active coatings for the anode that may be applied to the metal substrate are those provided from platinum or other platinum group metals or they can be represented by active oxide coatings such as platinum group metal oxides, magnetite, ferrite, cobalt spinel or mixed metal oxide coatings. Such coatings have typically been developed for use as anode coatings in the industrial electrochemical industry. They may be water based or solvent based, e.g., using alcohol solvent. Suitable coatings of this type have been generally described in one or more of the U.S. Pat. Nos. 3,265,526, 3,632,498, 3,711,385 and 4,528,084. The mixed metal oxide coatings can often include at least one oxide of a valve metal with an oxide of a platinum group metal including platinum, palladium, rhodium, iridium and ruthenium or mixtures of themselves and with other metals. Further coatings include tin oxide, manganese dioxide, lead dioxide, cobalt oxide, ferric oxide, platinate coatings such as $M_xPT_3O_4$ where M is an alkali metal and x is typically targeted at approximately 0.5, nickel-nickel oxide and nickel plus lanthanide oxides.

The coatings are typically obtained by applying a coating composition to an electrode substrate, drying the applied coating and then heating to form the coated electrode. The heating step is preferably effected at temperatures from about 350° to about 600° C. At temperatures below about 350° C., the curing of the coating may require too long a heating time and at temperatures above about 600° C., the electrode may be subjected to distortions.

I claim:

1. In an electrode structure for use in a vertical electrolysis cell having an at least substantially vertical cathode and an at least substantially vertical anode in said cell opposite said cathode, said electrode structure including blade electrodes spaced apart one from the other, and further including at least one horizontal conductor bar having a front face and a back face, with at least part of said conductor bar engaging a portion of each of said blade electrodes, and with boss electrical connector members secured to the back face of said conductor bar, the improvement in said electrode structure comprising:

an array of parallel, vertical blade electrodes, Delta shaped in cross-section, each secured on at least a portion of their back face with said conductor bar;

baffle means having front and back major faces, said baffle means extending vertically and at least substantially parallel to said array of blade electrodes, and having a front major face opposite the back faces of said blade electrodes and spaced apart from said blade electrodes;

an electrolyte circulation zone extending at least substantially vertically along the front face of said baffle means; and an electrolyte recirculation zone extending at least substantially vertically along the back face of said baffle means.

2. The structure of claim 1 wherein said blade electrodes, generally Delta shaped in cross-section, have a working face narrowing down to a forward edge away from said back face, and said blade electrodes are secured in a jointed manner to said conductor bar.

3. The structure of claim 2 wherein said blade electrodes that are secured in a jointed manner are indented into at least a portion of said conductor bar and are secured in a manner including welding.

4. The structure of claim 3 wherein said indentation is achieved during melting of conductor bar metal during welding.

5. The structure of claim 4 wherein said blade electrodes contact said conductor bar before welding, portions in contact of each of said blade electrodes and said conductor bar melt on welding providing pooling of metal, and said indentation of said blade electrodes into said conductor bar is achieved during said pooling of said metal.

6. The structure of claim 3 wherein said conductor bar includes a key member, said blade electrodes are indented into said key member, and said key member projects from one or more of the front face, or a leg, of said conductor bar.

7. The structure of claim 1 wherein said blade electrodes are one or more of blade cathodes or blade anodes, said blade electrodes as cathodes are metal cathodes and as anodes are valve metal anodes, said conductor bar is a valve metal conductor bar, and said blade electrodes are, in cross-section, one or more of triangular Delta shaped blade electrodes or chevron Delta shaped blade electrodes.

8. The structure of claim 7 wherein the metal of said cathodes is one or more of nickel plated steel, nickel, steel, alloys and intermetallic mixtures of nickel and steel, and the valve metal of said blade electrodes and the valve metal of said conductor bar is selected from the group consisting of titanium, tantalum, niobium, zirconium, their alloys and intermetallic mixtures.

9. The structure of claim 1 wherein said blade electrodes are coated with an electrochemically active coating.

10. The structure of claim 9 wherein said electrochemically active coating contains a platinum group metal, or metal oxide or their mixtures.

11. The structure of claim 10 wherein said electrochemically active coating contains at least one oxide selected from the group consisting of platinum group metal oxides, magnetite, ferrite, cobalt oxide spinel, and tin oxide, and/or contains a mixed crystal material of at least one oxide of a valve metal and at least one oxide of a platinum group metal, and/or contains one or more of manganese dioxide, lead dioxide, platinate substituent, nickel—nickel oxide and nickel plus lanthanide oxides.

12. The structure of claim 1 wherein at least one boss electrical connector member has a tapped hole and said tapped hole is internally threaded.

13. The structure of claim 1 wherein said boss electrical connector members each have a top face and said face is a coated metal face.

14. The structure of claim 1 wherein said boss electrical connector members are valve metal members and are welded by one or more of electrical resistance, tungsten inert gas or metal inert gas welding to said conductor bar.

15. The structure of claim 1 wherein said baffle means are one or more of metal or polymeric baffle means.

16. The structure of claim 15 wherein said metal is valve metal and the polymer of said polymeric baffle means comprises a fluorinated polymer.

17. The structure of claim 1 wherein said baffle means are secured to said conductor bar.

18. In the method of making an electrode structure for use in a vertical electrolysis cell having an at least substantially vertical cathode and at least substantially vertical anode in said cell opposite said cathode, said electrode structure including blade electrodes spaced apart one from the other, and further including at least one horizontal conductor bar having a front face and a back face, with at least part of said conductor bar engaging a portion of each of said blade electrodes, and with boss electrical connector members secured to the back face of said conductor bar, the improvement in said method comprising:

providing an array of parallel, vertical blade electrodes, Delta shaped in cross-section, each secured on at least a portion of their back face with said conductor bar;

affixing baffle means, having front and back major faces, to said conductor bar and extending said baffle means vertically at least substantially parallel to said array of blade electrodes, with the baffle means front major face positioned opposite the back faces of said blade electrodes and spaced apart from said blade electrodes;

establishing an electrolyte circulation zone extending vertically along the front face of said baffle means; and establishing an electrolyte recirculation zone extending vertically along the back face of said baffle means.

19. The method of claim 18 wherein said array of electrode blades are secured in jointed manner to said conductor bar.

20. The method of claim 19 wherein said blade electrodes are secured in jointed manner to said conductor bar by indenting at least a portion of said blade electrodes into said conductor bar.

21. The method of claim 20 wherein said blade electrodes are indented into said conductor bar by welding of said blades to said bar and said indentation is achieved by means of melting conductor bar metal during welding.

22. The method of claim 21 wherein said blade electrodes contact said conductor bar before welding, portions in contact of each of said blade electrodes and said conductor bar melt on welding providing pooling of metal, and said indentation of said blade electrodes into said conductor bar is achieved during said pooling of said metal.

23. The method of claim 21 wherein said conductor bar includes a key member, said blade electrodes are indented into said key member, and said key member projects from one or more of the front face, or a leg, of said conductor bar.

24. The method of claim 18 wherein said blade electrodes are coated with an electrochemically active coating.

25. The method of claim 24 wherein said electrochemically active coating contains a platinum group metal, or metal oxide or their mixtures.

26. The method of claim 25 wherein said electrochemically active coating contains at least one oxide selected from the group consisting of platinum group metal oxides, magnetite, ferrite, cobalt oxide spinel, and tin oxide, and/or contains a mixed crystal material of at least one oxide of a valve metal and at least one oxide of a platinum group metal, and/or contains one or more of manganese dioxide, lead dioxide, platinate substituent, nickel—nickel oxide and nickel plus lanthanide oxides.

27. The method of claim 18 further including coating at least a portion of said boss electrical connector members.

28. The method of claim 18 wherein said boss electrical connector members are secured to said conductor bar by welding.

29. The method of claim 28 wherein said boss electrical connector members are welded by one or more of electrical resistance welding, or tungsten inert gas or metal inert gas welding.

30. The method of claim 18 wherein at least one boss electrical connector member has an internally threaded connector hole tapped into said boss electrical connector member.

31. The method of claim 18 wherein at least one boss electrical connector member has an internal connector hole drilled into said boss electrical connector member and a portion of said drilled connector hole is enlarged by counter boring.

32. The method of claim 18 wherein said baffle means are affixed to said conductor bar by readily releasable means.

33. The method of claim 18 including establishing said electrolyte circulation zone with electrolyte in contact with said blade electrodes, and establishing said recirculation zone, with recirculating electrolyte in contact with the back face of said baffle means.

34. The method of claim 18 further including providing blade electrodes as one or more of blade anodes or blade cathodes, wherein said blade electrodes, in cross-section, are one or more of triangular Delta shaped blade electrodes or chevron Delta shaped blade electrodes.

35. An electrode structure made by the method of claim 18.

36. The method of electrolyzing an electrolyte in an electrolytic cell having an at least substantially vertical cathode and an at least substantially vertical anode in said cell opposite said cathode, at least one of said anode and said cathode including blade electrodes spaced apart one from the other, and further including at least one horizontal conductor bar having a front face and a back face, with at least part of said conductor bar engaging a portion of each of said blade electrodes, and with boss electrical connector members secured to the back face of said conductor bar, which method comprises:

providing an array of parallel, vertical blade electrodes Delta shaped in cross-section, each secured on at least a portion of their back face with said conductor bar;

providing electrical connection to said blade electrodes from said boss electrical connector members through said conductor bar;

establishing baffle means having front and back major faces, said baffle means extending at least substantially vertically and at least substantially parallel to said array of blade electrodes, with the front major face of said baffle means positioned opposite the back faces of said blade electrodes, and spaced apart from said blade electrodes, providing an electrolyte circulation zone in front of said baffle means, including said blade electrodes in said electrolyte circulation zone;

feeding electrolyte into said electrolyte circulation zone and circulating same vertically along the front face of said baffle means and in contact with said blade electrodes;

feeding electrolyte from said electrolyte circulation zone to an electrolyte recirculation zone extending vertically along the back face of said baffle means; and recirculating said electrolyte along said back face of said baffle means through said recirculation zone.

37. The method of claim 36 wherein electrolyte in said circulation zone travels upwardly in contact with said blade electrodes, discharges from the top of said circulation zone into said recirculation zone, and recirculates downwardly in said recirculation zone, said blade electrodes are one or more of blade anodes or blade cathodes, and said blade electrodes, in cross-section, are one or more of triangular Delta shaped blade electrodes or chevron Delta shaped blade electrodes.

38. In an electrode structure for use in a vertical electrolysis cell as one or more of an at least substantially vertical cathode or an at least substantially vertical anode in said cell opposite said cathode, said electrode structure including an array of parallel, vertical blade electrodes spaced apart one from the other, and further including at least one horizontal conductor bar having a front face and a back face, with at least part of said conductor bar engaging a portion of each of said blade electrodes, and with boss electrical connector members secured to the back face of said conductor bar, the improvement in said electrode structure comprising:

baffle means having front and back major faces, said baffle means extending at least substantially vertically and at least substantially parallel to said array of blade electrodes, and having a front major face opposite the back faces of said blade electrodes and spaced apart from said blade electrodes;

an electrolyte circulation zone extending vertically along the front face of said baffle means; and an electrolyte recirculation zone extending vertically along the back face of said baffle means.

39. The structure of claim 38 wherein said baffle means are one or more of metal or polymeric baffle means.

40. The structure of claim 39 wherein said metal is valve metal and the polymer of said polymeric baffle means comprises a fluorinated polymer.

41. The structure of claim 38 wherein said baffle means are secured to said conductor bar.

42. The structure of claim 38 wherein electrolyte in said circulation zone travels upwardly in contact with said blade electrodes and the front face of said baffle means, said electrolyte discharges from the top of said circulation zone into said recirculation zone, and recirculates downwardly in said recirculation zone between the back face of said baffle means and cell divider means.

43. In an electrode structure for a bipolar electrolytic cell having an anode and a cathode, with each electrode of the cell having a boss electrical connector member associated therewith, and with the structure having cell divider means interposed between adjacent anodes and cathodes, the improvement said electrode structure comprising:

an anode boss electrical connector member abutting against an adjacent cathode boss electrical connector member, said anode and cathode boss electrical connector members each having a hole extending transversely therein, at least one hole being at least partially internally threaded, and with adjacent transverse holes being coaxially aligned in said electrode structure;

a securing member contained within coaxially aligned adjacent holes, said securing member having an externally threaded shank;

a circumferential sealing member around the end of said shank adjacent said head;

a recess around adjacent boss electrical connector members for receiving said cell divider means; and baffle means affixed to a conductor bar that is itself secured to at least one boss electrical connector member, said baffle means extending away from said boss electrical connector member and establishing an electrolyte recirculation zone extending around said boss electrical connector member between said baffle means and said cell divider means.

44. The electrode structure of claim 43 wherein said internal threading in said transverse hole engages said external threading on said securing member shank.

45. The electrode structure of claim 43 wherein at least one boss connector member has a tapped transverse hole and said tapped transverse hole is at least partially internally threaded.

46. The electrode structure of claim 43 wherein at least one boss electrical connector member has a drilled transverse hole and a portion of said drilled transverse hole is enlarged by counter boring.

47. The electrode structure of claim 43 wherein said cell divider means inserted into a recess has a sealing member interposed between said cell divider means and said boss electrical connector members.

48. The electrode structure of claim 43 wherein said anode boss electrical connector member has a top face engaged against a top face of said cathode boss electrical connector member.

49. The electrode structure of claim 48 wherein said securing member provides bolted contact means between said engaged top faces and one or both of said top faces is a coated face.

50. The electrode structure of claim 49 wherein said coated face is a metal plated face.

51. The electrode structure of claim 48 wherein said cathode is a metal cathode of one or more of nickel plated steel, nickel, steel, alloys and intermetallic mixtures of nickel and steel, and said securing member is a metal member of the same metal as for said cathode.

52. The electrode structure of claim 43 wherein said baffle means are one or more of metal or polymeric baffle means.

53. The electrode structure of claim 43 wherein said metal is valve metal and the polymer of said polymeric baffle means comprises a fluorinated polymer.

54. The electrode structure of claim 43 wherein said sealing member comprises a circumferential gasket molded to a circumferential metal frame.

55. The electrode structure of claim 43 wherein electrolyte travels upwardly in contact with electrodes and a face of said baffle means, and recirculates downwardly in said recirculation zone between said baffle means and said cell divider means.

56. A blade electrode adapted for use in an electrolysis cell having an array of parallel blade electrodes spaced apart one from the other, which blade electrode comprises an elongate electrode, chevron Delta shaped in cross-section, having a front, rounded edge, a two-sided active outer face and a two-sided inner face, said outer and inner faces extending and meeting in back edges.

57. The blade electrode of claim 56 wherein said inner face is an active face and said back edges are flat or rounded back edges.

58. The blade electrode of claim 56 wherein said active face is an electrochemically active face coated with an electrochemically active coating.

59. The blade electrode of claim 58 wherein said electrochemically active coating contains a platinum group metal, or metal oxide or their mixtures.

60. The blade electrode of claim 56 wherein said electrode has a thickness, as measured transversely to its elongation, and across said back edges, within the range of from about 0.05 to about 0.1 inch and a height from said front edge to said back edges within the range of from about 0.2 to about 0.3 inch.

* * * * *